US007696422B1

(12) United States Patent
Chang

(10) Patent No.: US 7,696,422 B1
(45) Date of Patent: Apr. 13, 2010

(54) HEELLESS INSTRUMENT PEDAL DEVICE

(75) Inventor: Ming-Yi Chang, Taichung (TW)

(73) Assignee: Remarkable Company, Taichung (TW)

( * ) Notice: Subject to any disclaimer, the term of this patent is extended or adjusted under 35 U.S.C. 154(b) by 0 days.

(21) Appl. No.: 12/436,184

(22) Filed: May 6, 2009

(51) Int. Cl.
*G10D 13/02* (2006.01)

(52) U.S. Cl. ..... 84/422.1; 84/422.2; 84/422.3

(58) Field of Classification Search ..... 84/422.1, 84/422.2, 422.3
See application file for complete search history.

(56) References Cited

U.S. PATENT DOCUMENTS

| | | | | | |
|---|---|---|---|---|---|
| 922,706 | A * | 5/1909 | Ludwig | 84/422.2 |
| 938,899 | A * | 11/1909 | Schipper | 84/422.2 |
| 1,154,120 | A * | 9/1915 | Kendrick | 84/422.1 |
| 1,386,605 | A * | 8/1921 | Danly | 84/422.2 |
| 1,808,085 | A * | 6/1931 | Troppe | 84/422.1 |
| 1,892,223 | A * | 12/1932 | Sansone et al. | 84/419 |
| 2,132,211 | A * | 10/1938 | Hueckstead | 84/422.1 |
| 2,475,542 | A * | 7/1949 | Boykins | 84/422.1 |
| 2,784,635 | A * | 3/1957 | Troppe | 84/422.1 |
| 2,787,930 | A * | 4/1957 | Della-Porta | 84/422.1 |
| 2,845,815 | A * | 8/1958 | Koehler et al. | 74/513 |
| 3,030,847 | A * | 4/1962 | Thompson | 84/422.1 |
| 3,464,305 | A * | 9/1969 | Meazzi et al. | 84/422.3 |
| 3,968,718 | A * | 7/1976 | Carver | 84/422.1 |
| 4,315,453 | A * | 2/1982 | Gabor et al. | 84/422.3 |
| 4,381,690 | A * | 5/1983 | Kimble | 84/422.3 |
| 4,664,012 | A * | 5/1987 | Barca | 84/422.1 |
| 4,667,562 | A * | 5/1987 | Lee | 84/422.3 |
| 4,945,803 | A * | 8/1990 | Norwood | 84/422.1 |
| 5,028,776 | A * | 7/1991 | Forti et al. | 250/229 |
| 5,458,039 | A * | 10/1995 | Ashby | 84/422.1 |
| 5,990,401 | A * | 11/1999 | Braun et al. | 84/422.1 |
| 6,545,204 | B1 * | 4/2003 | Wadell | 84/422.1 |
| 6,683,240 | B1 * | 1/2004 | Cubranich | 84/465 |
| 7,321,092 | B2 * | 1/2008 | Hauck | 84/422.1 |
| 7,339,103 | B2 * | 3/2008 | Hilburn | 84/422.1 |
| 7,396,986 | B2 * | 7/2008 | Packer | 84/422.1 |
| 7,511,212 | B1 * | 3/2009 | Chang | 84/422.3 |
| 7,601,902 | B1 * | 10/2009 | Lombardi | 84/422.1 |
| 2002/0152872 | A1 * | 10/2002 | O'Donnell | 84/422.1 |

* cited by examiner

*Primary Examiner*—Jeffrey Donels
*Assistant Examiner*—Robert W Horn
(74) *Attorney, Agent, or Firm*—Wang Law Firm, Inc.; Li K. Wang

(57) ABSTRACT

A heelless instrument pedal device includes a bottom board and a pedal board. The bottom board is in connection with an instrument support and has two pivotal connection elements protruding upwards with a ball shape. The rear bottom surface of the pedal board has a pivotal connection base corresponding to the pivotal connection elements. The pedal board is connected to the pivotal connection elements on the bottom board using the pivotal connection base. Thus, the pedal board can swing in the direction of the force applied by the user's foot. The front end of the pedal board has a linking element, so that the linking element moves as the pedal board swings with respect to the pivotal connection elements.

6 Claims, 6 Drawing Sheets

HEELLESS INSTRUMENT PEDAL DEVICE

BACKGROUND OF THE INVENTION

1. Field of Invention

The invention relates to an instrument pedal device and, in particular, to a heelless instrument pedal device of a lower production cost.

2. Related Art

A conventional instrument pedal device, as shown in FIG. 6, consists of a bottom board 1 whose front is connected to the bottom side of an instrument support 2. The rear end of the bottom board 1 is further provided with a heel pedal 3. A pedal 4 is pivotally connected with the heel pedal 3 by its rear end and a pivotal axle 5. The front end of the pedal 4 is connected with a chain 6 so that its front end goes upwards. Therefore, the pedal can swing in the direction of the forced applied by the user.

However, the above-mentioned conventional instrument pedal device uses the pivotal axle 5 to go through the pedal 4 and the heel pedal 3 simultaneously. Therefore, it has a higher requirement for the precision. This does not increase the manufacturing time, but also has to take into account the structural strength of the pivotal axle 5. This is why most instrument pedal devices on the market are made of aluminum or other metal materials. It is thus difficult to reduce the production cost. Besides, after being used for a certain time, the pivotal axle 5 of the conventional instrument pedal device is eroded to have a gap. This produces noises or makes the operation less smooth.

In view of the foregoing, the inventor of the invention provides a solution for the above-mentioned problems in the prior art.

SUMMARY OF THE INVENTION

An objective of the invention is to provide a heelless instrument pedal device that can be quickly and readily assembled and does not require an additional heel to connect with the pedal pivotally. This has the advantage of simplifying the production process.

Another objective of the invention is to provide a heelless instrument pedal device whose production cost can be greatly reduced by making a pedal with a predetermined number of integrally formed pivotal bases by plastic injection. The pedals thus made have more variations in their shapes.

A third objective of the invention is to provide a heelless instrument pedal device that enables smooth operations because there is no gap between its pivotal connection element and pivotal base. This is achieved by using the concave surface of the pivotal base to cover the pivotal connection element.

To achieve the above-mentioned objectives, the disclosed heelless instrument pedal device includes: a bottom board and a pedal board.

The bottom board connects to an instrument support and has two separate pivotal connection elements that protrude upwards into a ball shape.

The pedal board has pivotal connection bases corresponding to the two pivotal connection elements. It uses the two pivotal connection bases to connect with the pivotal elements on the bottom board. The pedal board can thus swing in the direction of the force applied by the user. The front end of the pedal board connects with a linking element. When the pedal board swings with respect to the two pivotal elements, the linking element also moves.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
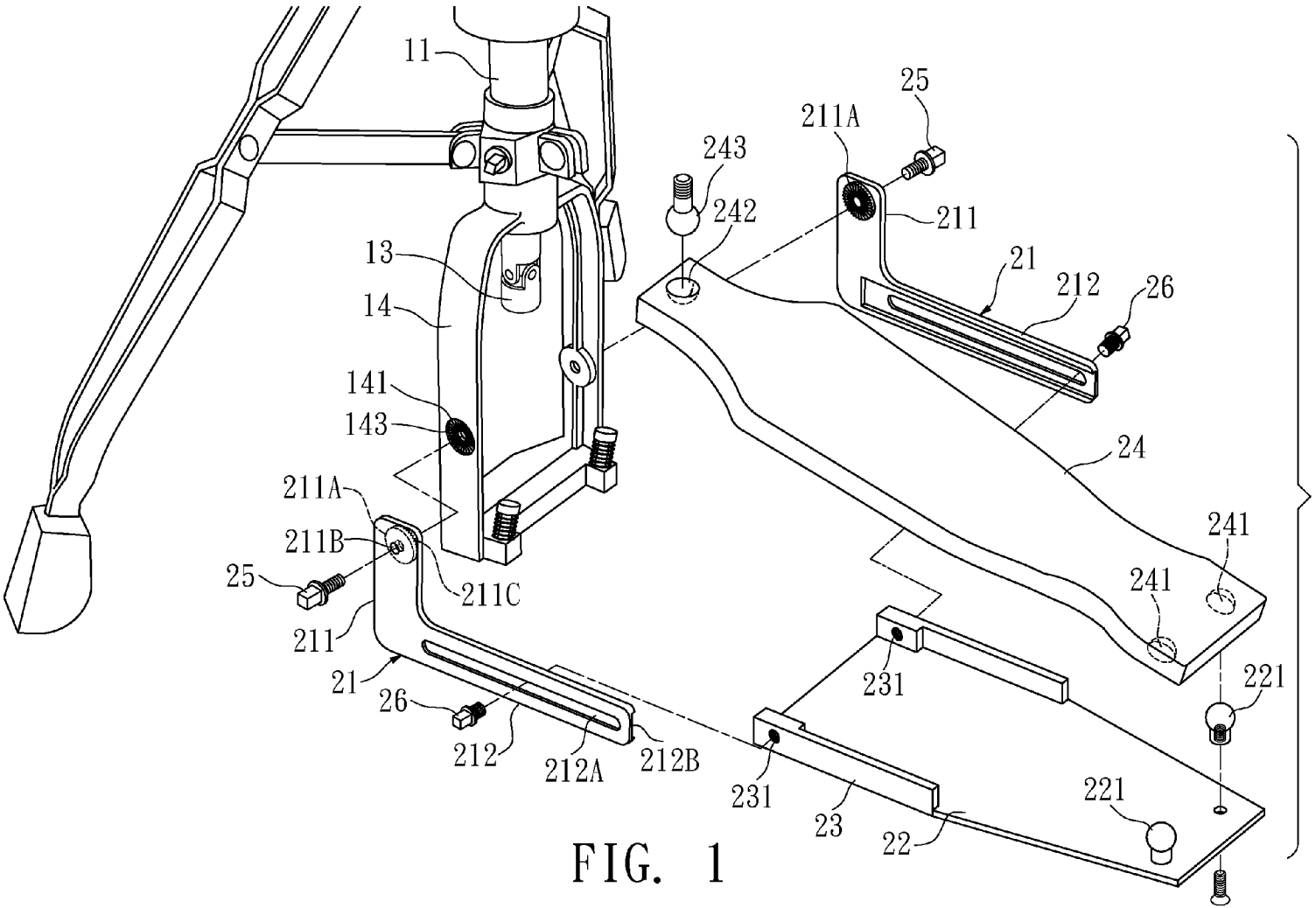
FIG. 1 is a three-dimensional exploded view of the invention.
Figure 2:
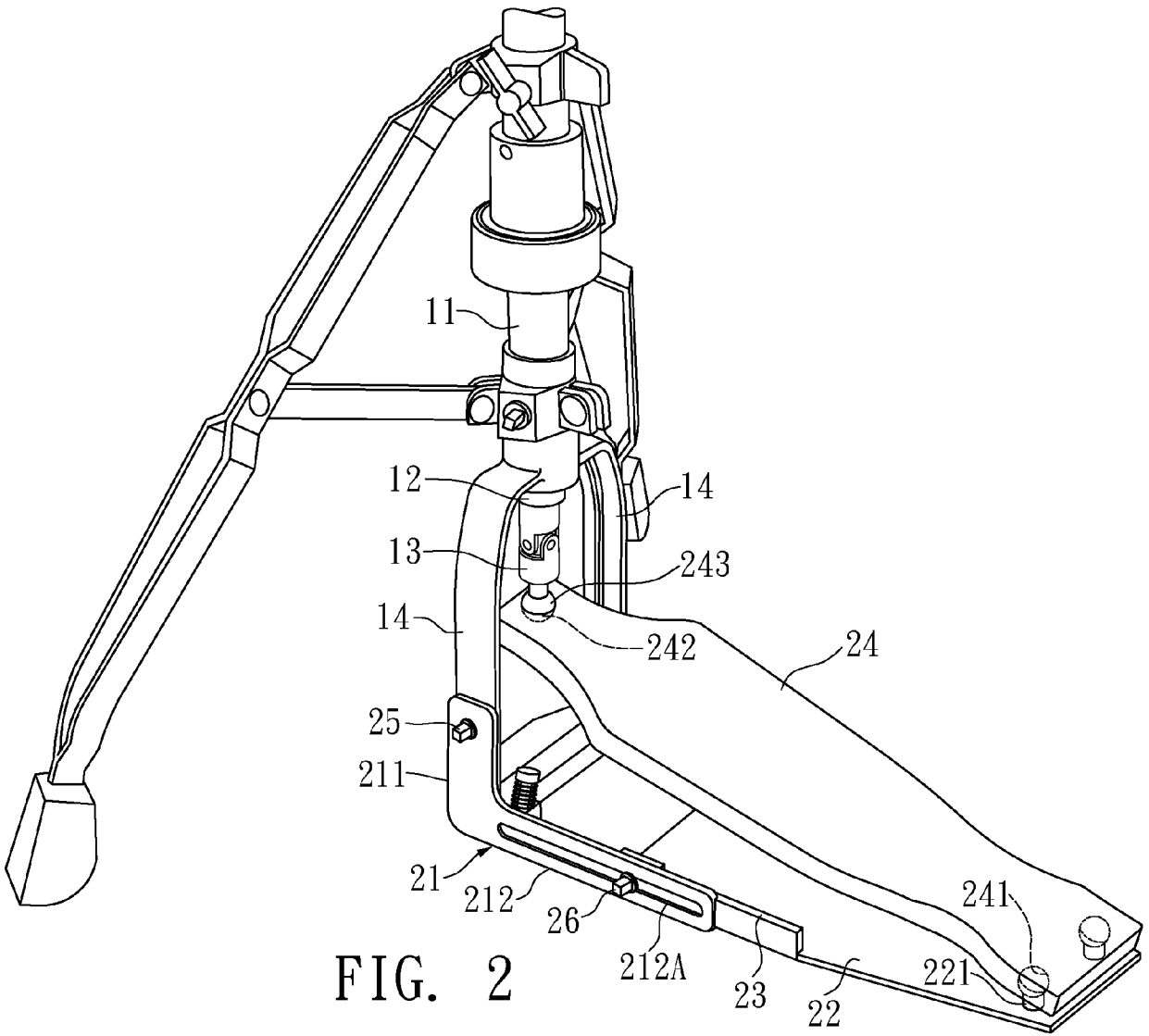
FIG. 2 is a three-dimensional view of the assembled invention.
Figure 3:
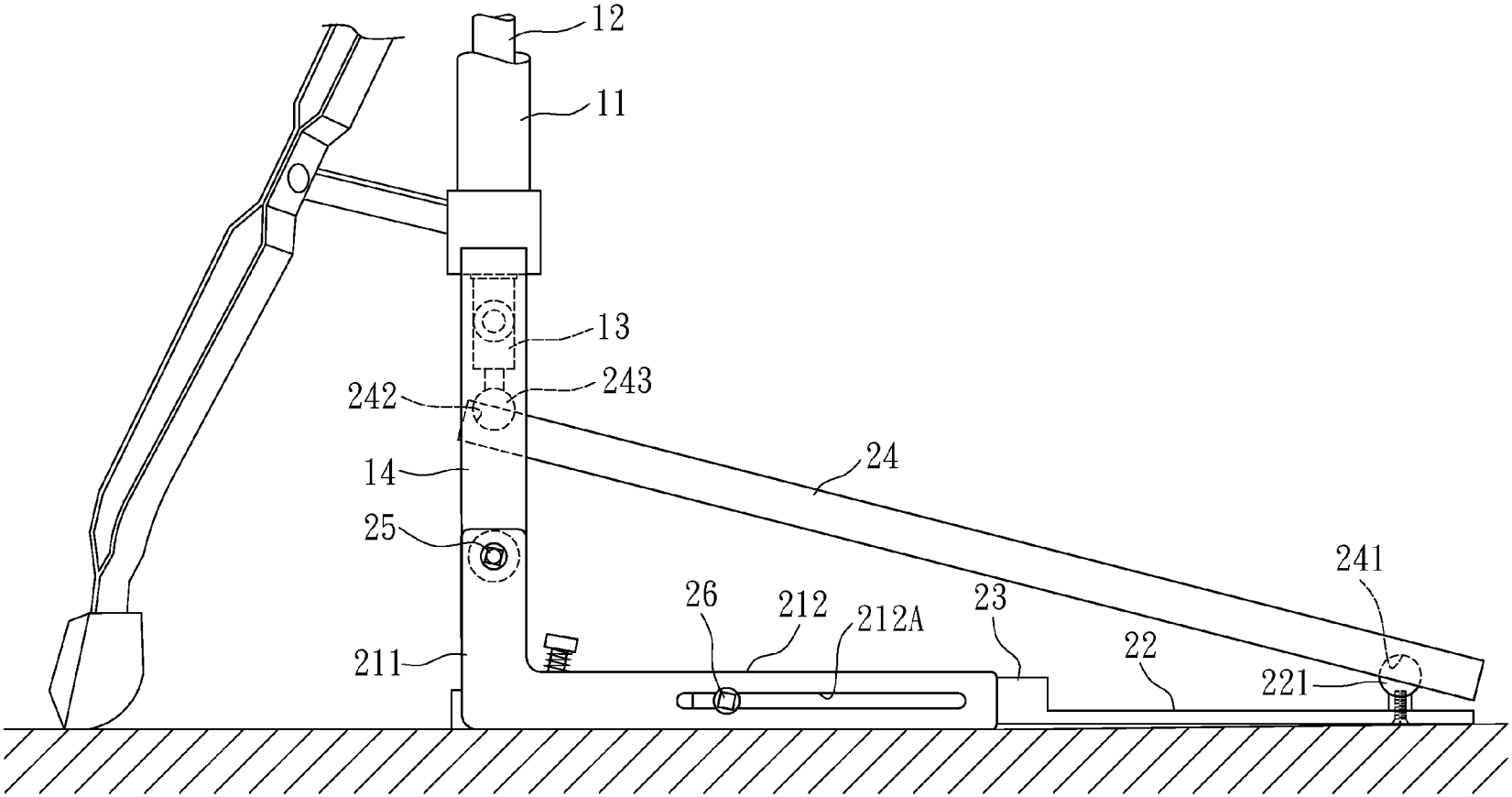
FIG. 3 is a side view of the assembled invention.

Please refer to FIGS. 1 to 3 for a first embodiment of the invention. The disclosed heelless instrument pedal device connects with an instrument support. In this embodiment, the instrument is a pair of cymbals as an example. The instrument support has a vertical post 11. A pulling bar 12 whose top end can connect with the instrument goes through the post 11. The bottom of the pulling bar 12 connects with a linking element. In practice, the linking element is a universal joint 13. Both sides near the bottom of the post 11 extend outwards and downwards a supporting bar 14, respectively. The supporting bars 14 on both sides of the post 11 form a gate shape. The linking element (i.e., the universal joint 13) is interposed between the two supporting bars 14. The out sidewalls of the two supporting bars 14 have a round concave part 141, respectively. The two concave parts 141 face opposite directions. The center of each of the concave parts 141 has a connecting hole 142. A first annular tooth part 143 is formed around the connecting hole 142 on the bottom surface of the concave part 141.

The disclosed heelless instrument pedal device includes two side supports 21, a bottom board 22, and a pedal board 24.

Each of the side supports 21 has a first section 211 and a second section 212 that are perpendicular to each other to form an L shape. The first section 211 of each of the side supports 21 has a round protruding part 211A, respectively. The center of the protruding part 211A has a through hole 211B. A second annular tooth part 211C is formed around the through hole 211B on the outer side surface of the protruding part 211A. The protruding part 211A of each of the side supports 21 matches with the concave part 141 of the supporting bar 14. The second annular tooth part 211C at the protruding part 211A and the first annular tooth part 143 of the concave part 141 engage with each other. A first locking element 25 goes through the through holes 211B of the side supports 21 and the connecting holes 142 of the supporting bars 14. It has the function of locking when the first annular tooth part 143 engages with the second annular tooth part 211C. The second section 212 of each of the side supports 21 has a long guiding hole 212A, respectively. A rail 212B is provided on the sides of the second sections 212 of the two side supports 21 that face each other. The guiding hole 212A is hollow at a place corresponding to the rail 212B.

Both sides on the front end of the bottom board 22 protrude two opposite sidewalls 23. Each of the sidewalls 23 has an open hole 231, respectively. The bottom board 22 slides in the rails 212B of the side supports 21 by its sidewalls 23. A second locking element 26 goes through the guiding holes 212A and the open holes 231 for locking. The bottom board 22 can be adjusted to extend outwards relative to the second section 212 of the corresponding side support 21. The end of the bottom board 22 has two separate first pivotal elements 221 that protrude upwards into a ball shape.

The bottom surface on the rear end of the pedal board 24 is formed with a concave first pivotal connection base 241 corresponding to the first pivotal connection element 221. The top surface on the front end of the pedal board 24 has a second pivotal connection base 242 for accommodating a second pivotal connection element 243 also in a ball shape. The front end of the pedal board 24 rises upwards and connects to the bottom of the linking element (i.e., the universal joint 13) by its second pivotal connection element 242. The rear end of the pedal board 24 connects to the first pivotal connection element 221 on the bottom board 22 using the first pivotal connection base 241. Thus, the pedal board 24 can swing with respect to the first pivotal elements 221 in the direction of force applied by the user.

The pedal board 24 and the bottom board 22 of the invention are connected using the ball-shaped pivotal connection elements 221 and pivotal connection bases 241. Therefore, they can be quickly and readily assembled. The invention does not require an additional heel to connect with the pedal board 24 pivotally. The production process can thus be simplified. The pedal board 24 can be integrally formed with a predetermined number of pivotal connection bases 241, 242 by plastic injection. This greatly reduces the production cost. Moreover, the pedal boards 24 thus made have more variations in shape.

After the pedal board 24 and the bottom board 22 are assembled, the pivotal connection bases 241 enclose the pivotal connection elements 221 using their concave surfaces. Therefore, there is no gap between the pivotal connection elements 221 and the pivotal connection bases 241. This ensures the smooth operations of the invention.

Figure 4:
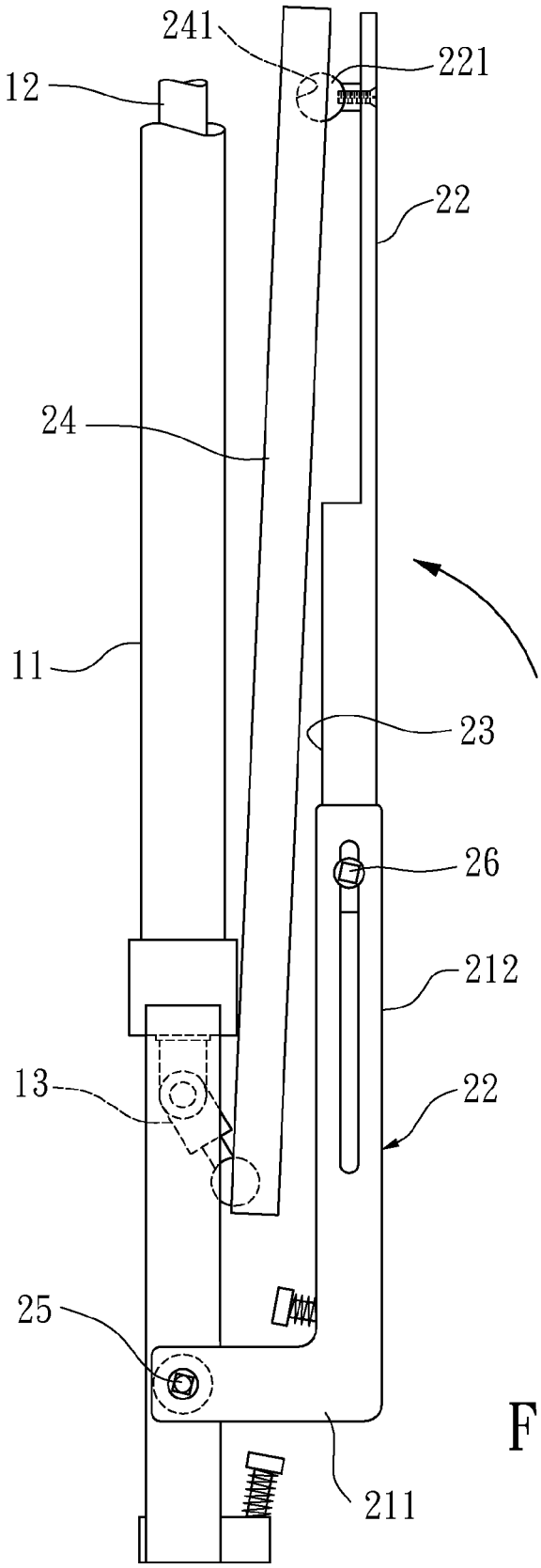
FIG. 4 is a schematic view showing that the pedal device is collapsed.

Please continue to refer to FIG. 4. To collapse the pedal board 24, one loosens each of the first locking elements 25. The second sections 212 of the two side supports 21 are collapsed toward the supporting bars 14. After the pedal board 24 and the bottom board 22 are folded upwards, each of the locking elements 25 is fastened to complete the process of collapsing the instrument pedal device.

Figure 5:
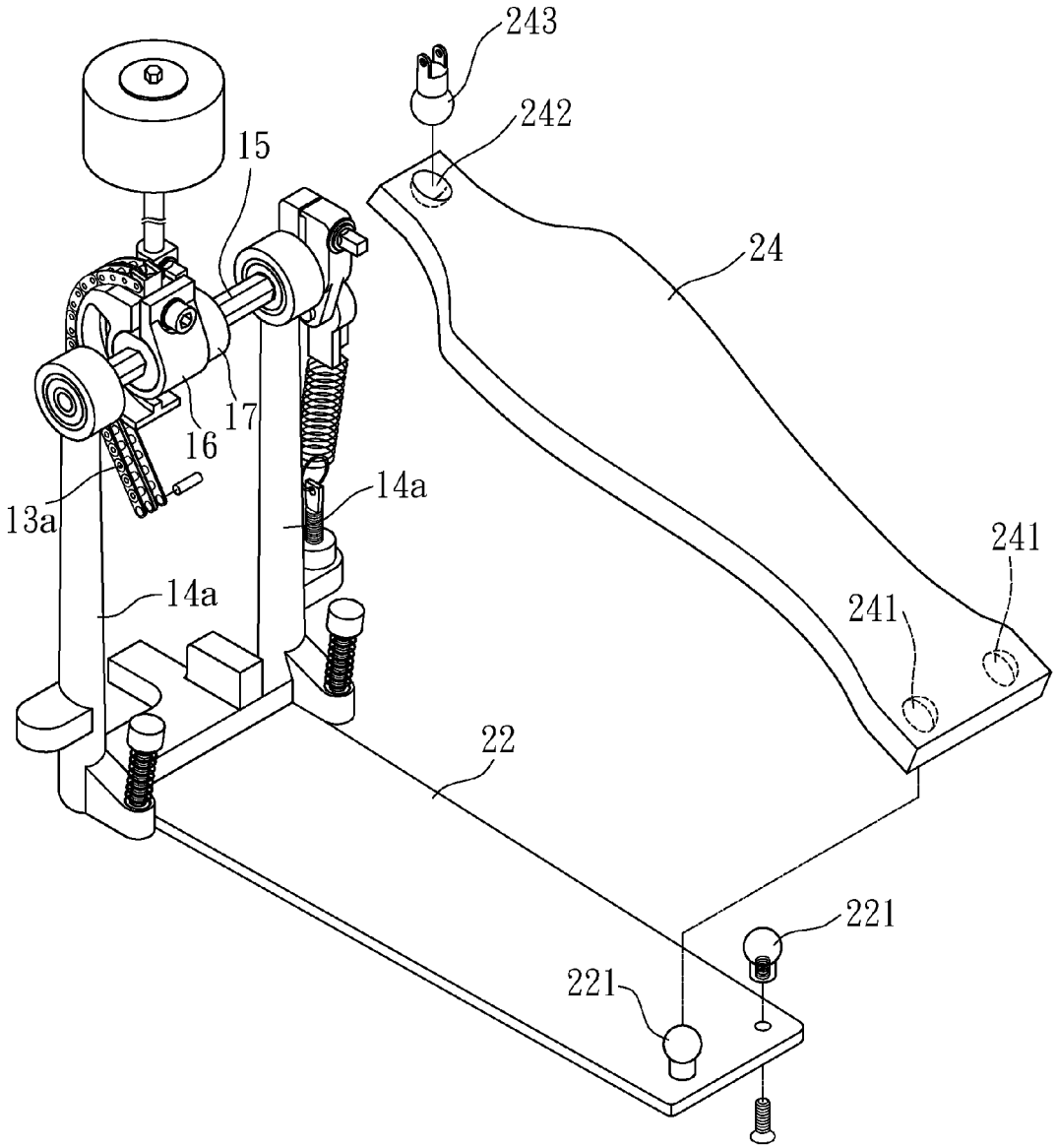
FIG. 5 is a three-dimensional view of another embodiment of the invention.
Figure 6:
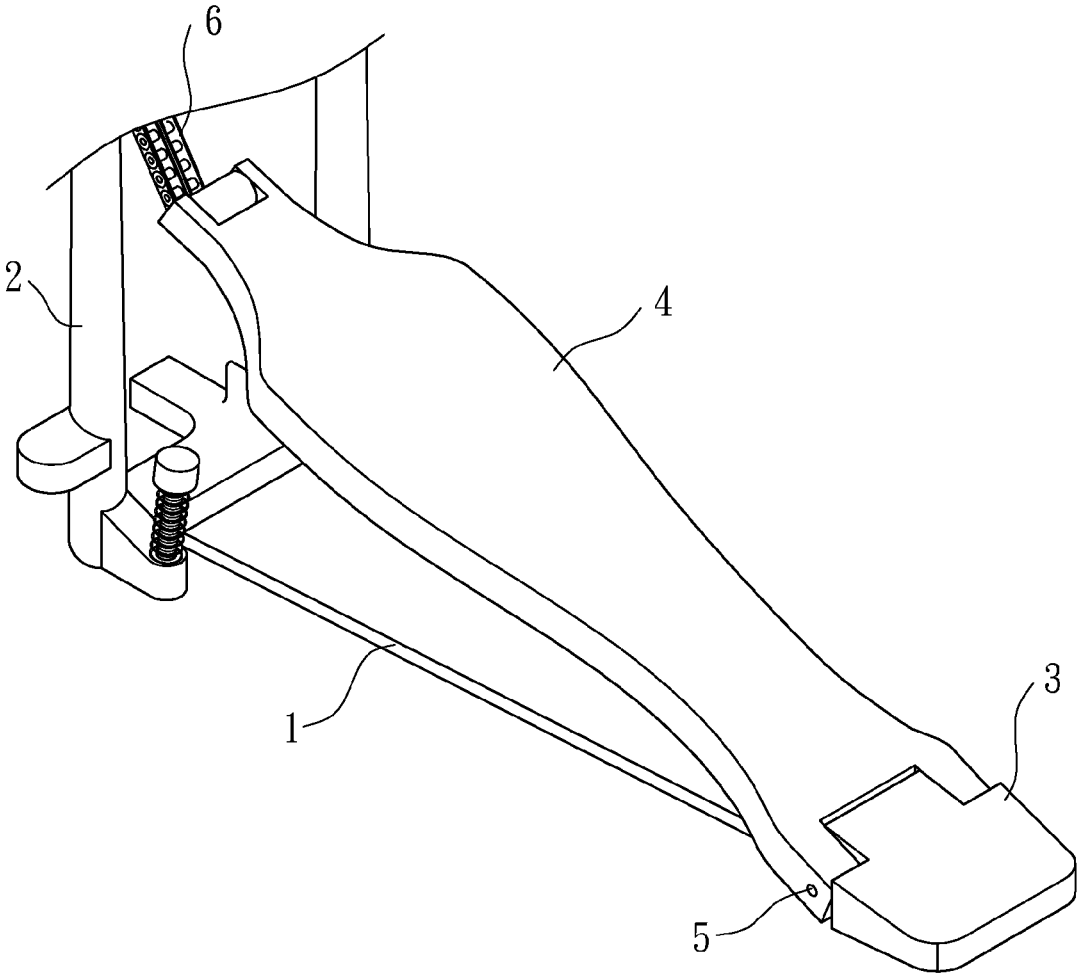
FIG. 6 PRIOR ART
FIG. 6 is a schematic view of a conventional instrument pedal device.

FIG. 5 shows another embodiment of the invention. In this embodiment, the instrument is a drumstick as an example. The instrument support has two vertical posts 14*a*. An axle 15 strides across the top edges of the two posts 14*a*. The axle 15 is mounted with a cam element 16 and a drumstick fixing part 17. One end of the linking element connects to the outer edge of the cam element 16. In this embodiment, the bottom board 22 is a long plate whereas the linking element consists of a chain 13*a*. The bottom board 22 connects to the bottom side of the two posts 14*a* using its front end. The end of the bottom board 22 has two separate first pivotal connection element 221 that protrude upwards into a ball shape. The pedal board 24 connects to the other end of the linking element (i.e., the chain 13*a*) by the second pivotal connection element 243 pivotally disposed on the top surface of its front end. The rear end of the pedal board 24 uses the first pivotal connection bases 241 to connect to the first pivotal connection elements 221 of the bottom board 22. The pedal board 24 can swing in the direction of force applied by the user with respect to each of the first pivotal connection elements 221. The cam element 16 is simultaneously linked to drive the drumstick to hit a drum.

According to the above description, the step board device of any hitting instrument can connect to pivotal connection bases 241 using the corresponding ball-shaped pivotal connection elements 221. They are equivalents embodiments of the invention.

In summary, the disclosed instrument pedal device utilizes ball-shaped pivotal connection elements to connect to the corresponding pivotal connection bases. It does not require any additional heel to connect with the pedal board pivotally. Moreover, the pedal board with a predetermined number of pivotal connection bases can be integrally formed by plastic injection. This does not only reduce the production cost, but also renders pedal devices with various shapes. After the disclosed pedal board and bottom board are assembled, the pivotal connection bases enclose the pivotal connection elements by its concave surfaces. There is thus no gap between the pivotal connection elements and the pivotal connection bases. This ensures smooth operations of the invention. Therefore, the invention has shown great improvements over the prior art.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A heelless instrument pedal device, comprising:

a bottom board, which is in connection with an instrument support and has two pivotal connection elements that separately protrude upwards with a ball shape; and a pedal board, the bottom surface of whose rear end has pivotal connection bases corresponding to the two pivotal connection elements;

wherein the pedal board is connected onto the pivotal connection elements on the bottom board using the pivotal connection bases, the pedal board swings in the direction of the force applied by a user's foot, the front end of the pedal board has a linking element so that the linking element moves as the pedal board swings with respect to the two pivotal connection elements.

2. The heelless instrument pedal device of claim 1, wherein the top surface on the front end of the pedal board has a second pivotal connection base for accommodating a second pivotal connection element also in a ball shape and the second pivotal connection element is connected with the bottom end of the linking element.

3. The heelless instrument pedal device of claim 1 further comprising two side supports, wherein the instrument support has a vertical post through which a pulling bar is inserted to connect with an instrument by its top end; the bottom end of the pulling bar connects to the linking element; both sides near the bottom end of the post extends outwards and downwards a supporting bar, respectively; the linking element is between the two supporting bars; the outer sidewalls of the two supporting posts have a round concave part, respectively, in opposite directions; the center of each of the concave parts has a connecting hole; a first annular tooth part is formed on the bottom surface of the concave part around the connecting hole; each of the side supports has a first section and a second section that are perpendicular to each other and form an L shape; the first section of each of the side supports has a round protruding part whose center has a through hole; the outer surface of the protruding part surrounds the through hole to form a second annular tooth part; the protruding part of each of the side supports matches with the concave part of the supporting bar; the second annular tooth part at the protruding part engages the first annular tooth part of the concave part; a first locking element goes through the through holes of the side supports and the connecting hole of the supporting bar for locking after the first annular tooth part and the second annular tooth part engage with each other; the second section of each of the side supports has a long guiding hole; the second sections of the two side supports are provided with a rail on the surfaces that face each other; the guiding hole is hollow at the rail; both sides on the front of the bottom board are protruded with two opposite sidewalls, each of which has an open hole; the bottom board is disposed in the rails of the side supports by its sidewalls; and a second locking element goes through the guiding holes and the open holes for the bottom board to adjust its extended length relative to the section of the side supports.

4. The heelless instrument pedal device of claim 3, wherein the linking element is a universal joint.

5. The heelless instrument pedal device of claim 1, wherein the instrument support has two vertical posts with an axle striding across thereon, the axle is mounted with a cam and a drum stick fixing part, one end of the linking element connects to the outer edge of the cam, and the bottom board is connected to the bottom side of the two posts by its front end.

6. The heelless instrument pedal device of claim 5, wherein the linking element is a chain.

* * * * *